United States Patent [19]

Hodnett et al.

[11] Patent Number: 4,567,711

[45] Date of Patent: Feb. 4, 1986

[54] BAG MACHINE AND METHOD FOR SEALING NOVEL BAG

[75] Inventors: James W. Hodnett, Columbia; Doyle R. Hudson, West Monroe, both of La.

[73] Assignee: Ouachita Machine Works, Inc., West Monroe, La.

[21] Appl. No.: 632,377

[22] Filed: Jul. 19, 1984

[51] Int. Cl.[4] ..... B65B 61/02; B65B 51/02; B65B 51/18

[52] U.S. Cl. ..... 53/128; 53/373; 53/137; 53/383

[58] Field of Search ..... 53/128, 137, 371, 373, 53/383, 481, 482; 156/252, 253, 461, 464; 493/351, 390, 391, 392

[56] References Cited

U.S. PATENT DOCUMENTS

| | | | |
|---|---|---|---|
| 1,179,177 | 4/1916 | Hahn | 493/392 |
| 1,700,945 | 2/1929 | Loppacker | 493/390 |
| 1,715,809 | 6/1929 | Woodall | 53/286 |
| 2,003,339 | 6/1935 | Brady et al. | 384/459 |
| 2,097,447 | 11/1937 | Cundall et al. | 53/373 |
| 2,253,036 | 8/1941 | Kimple et al. | 53/373 |
| 2,290,564 | 7/1942 | Krueger | 493/231 |
| 2,309,760 | 2/1943 | First | 53/482 |
| 2,445,757 | 7/1948 | Belcher | 493/383 |
| 2,874,666 | 2/1959 | Thor | 493/390 |
| 2,899,347 | 8/1959 | Kindseth | 156/209 |
| 3,163,352 | 12/1964 | Fesco | 493/210 |
| 3,190,192 | 6/1965 | Neal | 493/335 |
| 3,203,322 | 8/1965 | Eichorn et al. | 493/390 |
| 3,338,019 | 8/1967 | Trewella et al. | 53/412 |
| 3,381,448 | 5/1968 | Ayres et al. | 53/373 |
| 3,460,313 | 8/1969 | Conner et al. | 53/64 |
| 3,505,774 | 4/1970 | Gidge | 53/415 |
| 3,567,537 | 3/1971 | Marteny et al. | 156/91 |
| 3,793,928 | 2/1974 | Wootten | 493/350 |
| 3,875,726 | 4/1975 | Harris et al. | 53/481 |
| 3,882,657 | 5/1975 | Fischbein et al. | 53/77 |
| 3,953,272 | 4/1976 | Webber | 156/152 |
| 3,953,634 | 4/1976 | Wootten | 428/133 |
| 3,969,992 | 7/1976 | Calderazzo | 493/390 |
| 4,041,673 | 8/1977 | Brooke et al. | 53/479 |
| 4,047,363 | 9/1977 | Vigneri | 53/371 |
| 4,110,953 | 9/1978 | Holmes | 53/419 |
| 4,278,488 | 7/1981 | Kopacz et al. | 156/464 |

*Primary Examiner*—Horace M. Culver
*Attorney, Agent, or Firm*—Norvell E. Von Behren; Donna J. Theis

[57] ABSTRACT

A novel bag machine and method for sealing a novel bag is disclosed. The bag is formed by positioning adjacent end surfaces of the bag tightly together and forming a plurality of tab structures on the ends of the bag which are turned against at least one of the end surfaces of the bag to lie flush therewith. Adhesive is applied to the area of the end surfaces and the tab structures and reinforcing tape is positioned over the adhesive and over the adjacent end surfaces to cover the turned tabs. The novel machine comprises a conveyor and a perforator assembly for conveying the bag and perforating the plurality of tab structures in combination with a tab turner to turn the tabs against one of the ends of the bag. Adhesive and reinforcing tape then are introduced into the sequence after which a cut-off and a pressure group complete the sequential operation of the machine. The method for applying adhesive to both sides of adjacent surfaces on a bag or similar material is also disclosed. A bag may have one or both ends sealed in the novel manner disclosed.

10 Claims, 24 Drawing Figures

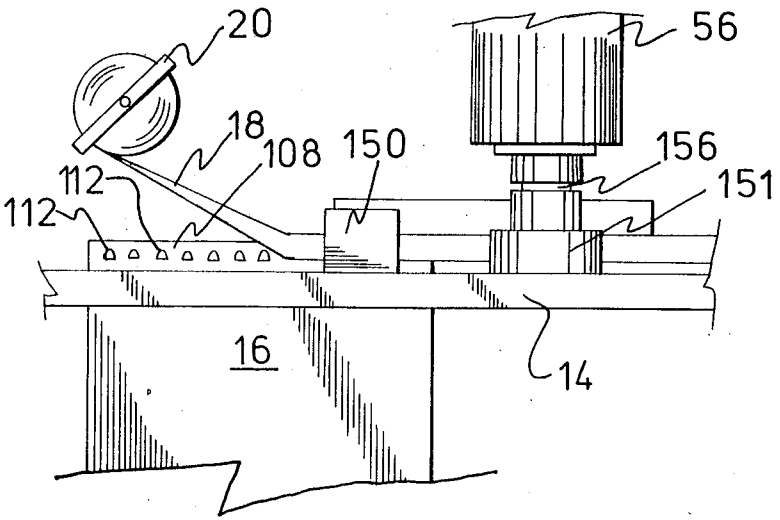
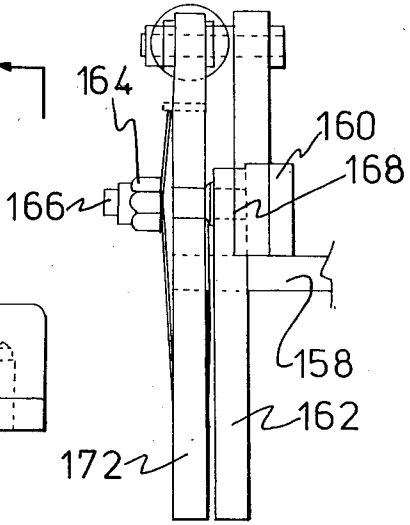
FIG-16
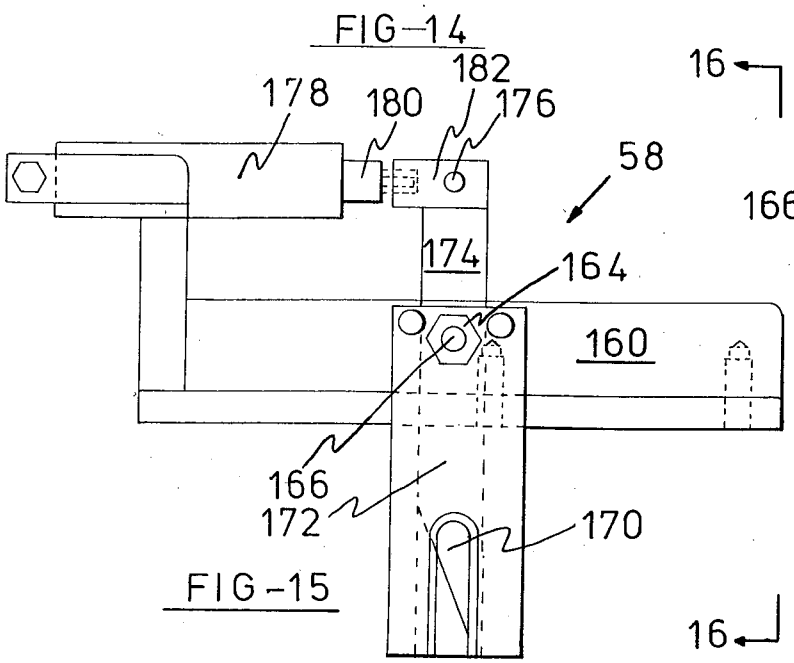
FIG-14
FIG-15
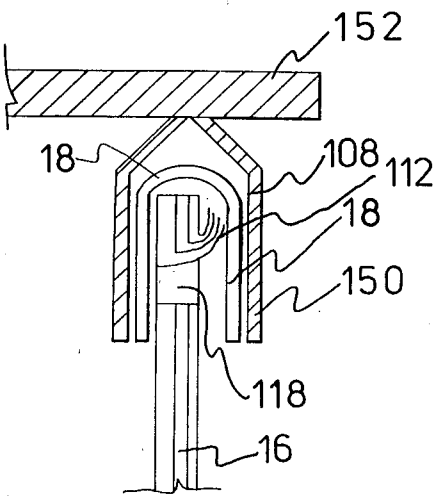
FIG-13
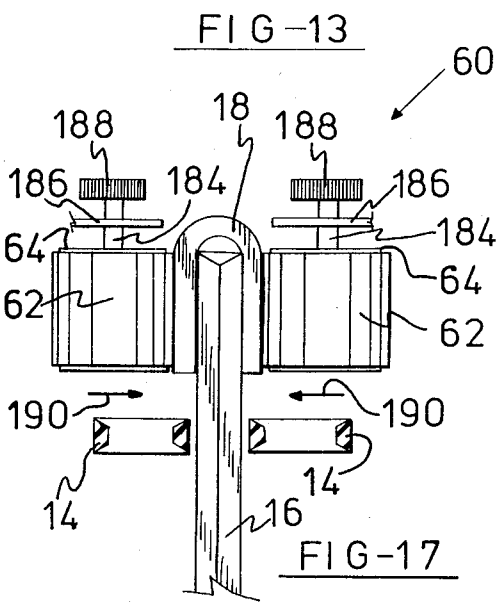
FIG-17

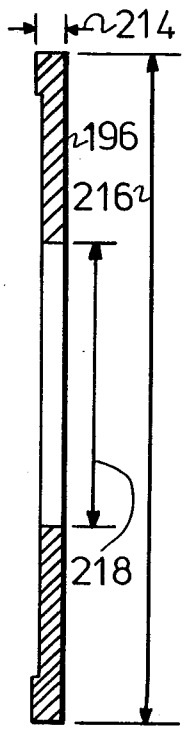
FIG-20
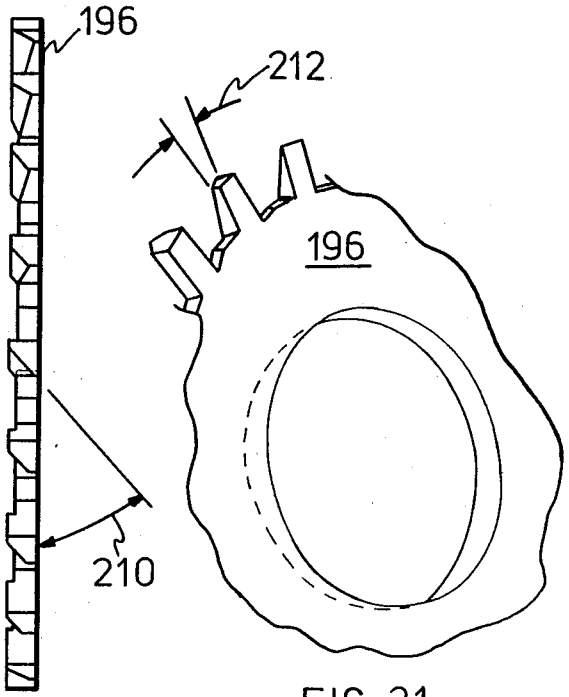
FIG-21
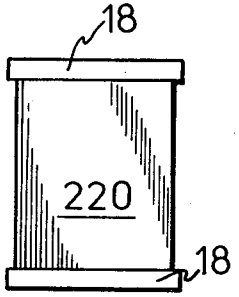
FIG-23
FIG-19
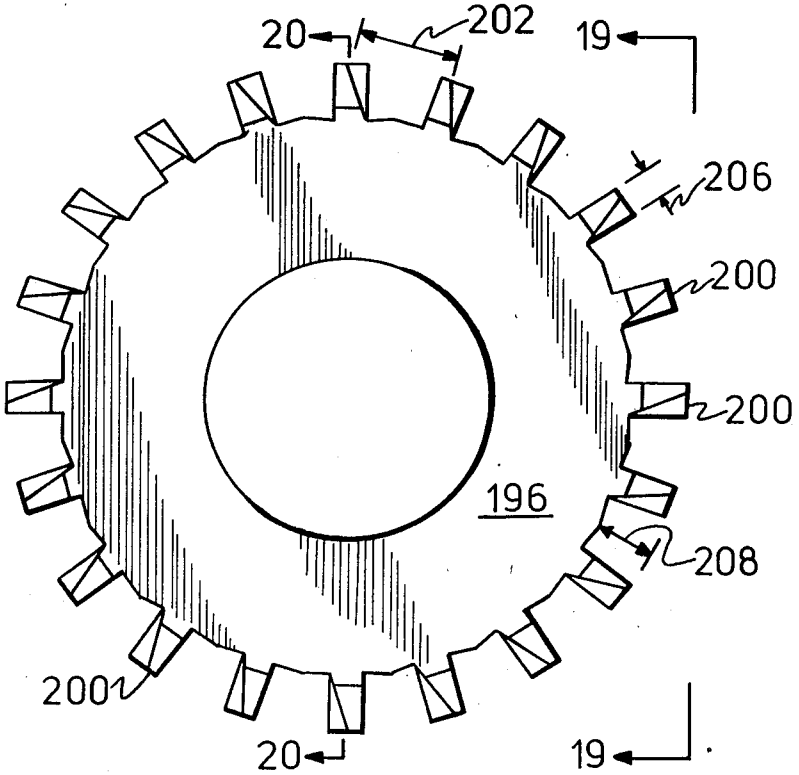
FIG-18
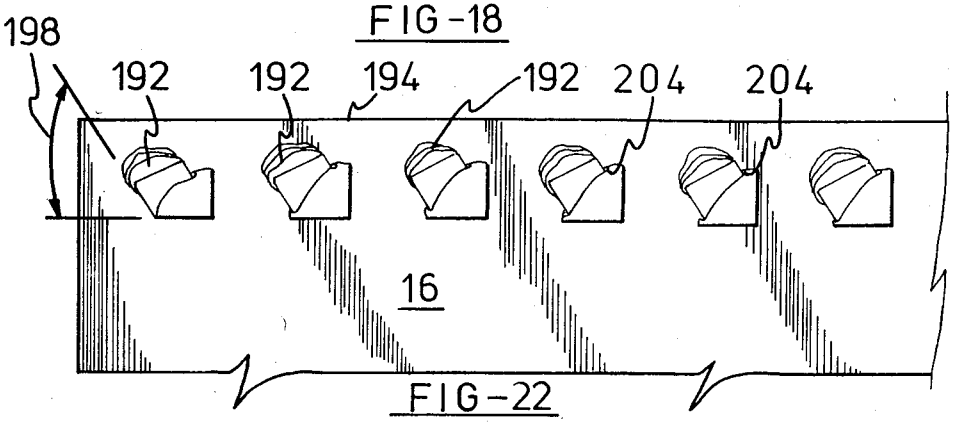
FIG-22

BAG MACHINE AND METHOD FOR SEALING NOVEL BAG

BACKGROUND OF THE INVENTION

This invention relates generally to bags and bag sealing machines and more particularly to a new and novel bag and machine and method for forming the closed end on the bag.

It is known in the manufacture of bags to seal one end of the bag by known sealing means after which the bag is passed through a filling line during which time the contents of the bag are placed in the package. Thereafter the other end or open end of the bag is closed in various manners such as sewing the top, applying reinforcing tape and sewing the top, glueing the top and various other known ways.

It is known to punch holes and tabs in various adjacent surfaces for purposes particularly related to the existing process. For example the U.S. Pat. No. 1,700,945, issued Feb. 5, 1929 to A. Loppacker shows a method of attaching the getter to the plate for vaccum tubes. In the U.S. Pat. No. 1,715,809, issued June 4, 1929 to J. H. Woodall there is shown a machine for sealing crate cushions by applying tape over the ends of the cushions.

Other methods of closing and sealing are taught in the U.S. Pat. No. 2,290,564, issued July 21, 1942 to T. H. Krueger which teaches a method of making carrying bags and other bags and envelopes. Another method for closing bag tubed ends is taught in the U.S. Pat. No. 2,445,757, issued July 27, 1948 to Daniel Belcher and in the U.S. Pat. No. 2,899,347, issued Aug. 11, 1959 to H. V. Kindseth. The latter patent uses punched holes with a reinforcing tape which is secured together through the holes.

In a similar manner the U.S. Pat. No. 3,163,352, issued Dec. 29, 1964 to J. J. Fesco uses the same sealing method. A patent teaching the sealing of connecting overlapped layers of corregated fiber board is the U.S. Pat. No. 3,190,192, issued June 22, 1965 to M. P. Neal.

Other methods for joining and splicing and adjacent parallel sheets are taught in the U.S. Pat. No. 3,203,322, issued Aug. 31, 1965 to R. N. Eichorn et al and in the U.S. Pat. No. 3,338,019, issued Aug. 29, 1967 to R. J. Treewella et al. A powered thermoplastic bag sealing process is taught in the U.S. Pat. No. 3,567,537, issued Mar. 2, 1971 to W. W. Marteny et al.

Tab connecting methods for joining two flat fiber or paper board panels are taught in the U.S. Pat. No. 3,793,928, issued Feb. 26, 1974 to William A. Wooten and in the U.S. Pat. No. 3,953,634, issued Apr. 27, 1976 to William A. Wooten.

Various bag filling, sewing, sealing and closing apparatus are taught in the following United States Patents: U.S. Pat. No. 2,003,337, issued June 4, 1935 to C. V. Brady et al; U.S. Pat. No. 2,097,447, issued Nov. 2, 1937 to R. N. Cundall et al; U.S. Pat. No. 2,253,036, issued Aug. 19, 1941 to L. C. Kimple et al; U.S. Pat. No. 3,381,448, issued May 7, 1968 to R. H. Ayres et al; U.S. Pat. No. 3,460,313, issued Aug. 12, 1969 to J. R. Conner et al; U.S. Pat. No. 3,505,774, issued Apr. 14, 1970 to L. Gidge; U.S. Pat. No. 3,875,726, issued Apr. 8, 1975 to Thomas C. Harris et al; U.S. Pat. No. 3,882,657, issued May 13, 1975 to Harold Fischbein et al; U.S. Pat. No. 3,953,272, issued Apr. 27, 1976 to Geoffrey T. Webber; U.S. Pat. No. 4,041,673, issued Aug. 16, 1977 to Arthur A. Brooke et al; U.S. Pat. No. 4,047,363, issued Sept. 13, 1977 to Alfonso Vigneri and in the U.S. Pat. No. 4,110,953, issued Sept. 5, 1978 to Gordon W. Holmes.

The before mentioned patents, while undoubtedly satisfactory for the intended purpose do not teach the new and novel bag machine and method for sealing the applicants novel bag as is taught by this application. With the advent of larger and heavier bags of material being sold on the marketplace, it is imperative that a positive and strong seal be placed on the top of the bag after the contents are filled into the bag. This is especially important since many times the top of the bag becomes a "handle" which is effectively grasped by the purchaser in carrying the filled bag to his automobile or home. Should the top of the bag be weak or not have a good seal applied thereto, the top will tear and the product will spill causing irritation to the consumer.

It is also important that a positive and strong seal be placed on the bottom of the bag prior to filling the bag to insure a good strong bag.

SUMMARY OF THE INVENTION

In order to overcome problems inherent in the before described bag sealing machines and methods of sealing adjacent sheets, there is taught in the applicants invention a new and novel bag machine and method for sealing a new and novel bag designed by the applicant. The novel bag comprises a bag having the adjacent surfaces positioned tightly together and having formed thereon a plurality of tab structures which are cut through the adjacent end surfaces and turned against at least one of the end surfaces to lie flush therewith. A quantity of adhesive is applied to the area of the end surfaces and through the opening formed by the tab to the opposite side of the bag where it strikes a stationary vertical wiper plate which wipes adhesive on the other side of the bag. A reinforcing tape is positioned over the adhesive and covers the turned tabs and is adhesively secured in place on the end surfaces of the bag to reinforce the end surfaces with the turned tab positioned and adhesively secured beneath the reinforcing means serving to form a tight sealed edge on the bag. This sealed edge reinforces the bag edge to make the bag more adaptable to be carried by the edge and to prevent spillage of the contents of the bag. The bottom bag edge may also be sealed similarly.

The applicants novel machine comprises a conveyor means which conveys the filled bag through a machine frame into a perforator assembly which perforates the plurality of tab structures along the open end of the filled bag. A tab turner is positioned downstream from the perforator assembly for turning the tabs against one of the ends of the filled bag and the adhesive is applied to both sides of the bag ends as before mentioned or in other manners. After the reinforcing tape is applied cut off means carried by the machine frame and positioned downstream from the application of the reinforcing means are used to cut off the tape at a predetermined location after which the bag passes through pressure means which apply pressure to the applied reinforcing tape until the adhesive sets thereby providing a tightly sealed and reinforced bag.

Accordingly it is an object and advantage of the invention to provide a new and improved sealed bag where the adjacent ends are tightly positioned together and the ends have turned tabs which are adhesively secured in place after which reinforcing tape is applied making the bag a much stronger reinforced bag.

Another object and advantage of the invention is to provide a new and novel bag sealing machine having novel methods for sealing the bag before mentioned.

Yet another object and advantage of the invention is to provide a new and novel method of applying adhesive to both sides of adjacent surfaces for use in a bag sealing machine or in other machines with the novel method comprising spraying adhesive on one side of the bag and through openings formed by punched and turned tabs to an adjacent vertical wiper plate which wipes the other side of the adjacent surfaces of the bag with the adhesive.

Still yet another object and advantage of the invention is to provide a new and novel bag which has a much improved reinforced top and/or bottom due to the novel configuration of the bag structure and the method of forming the structure in the bag machine.

These and other objects and advantages of the invention will become apparent from a review of the drawing accompanying this invention showing the invention in its many aspects and from a study of the hereinafter description of the preferred embodiment which is given by way of illustration only.

BRIEF DESCRIPTION OF THE DRAWINGS

FIG. 13, is a sectional view, taken along line 13—13 of FIG. 5 showing in greater detail the positioning of the reinforcing means to the side of the open bag ends over the tabs and openings formed by the tabs.

FIG. 14, is a side view, taken along line 14—14 of FIG. 5 showing in greater detail the positioning of the reinforcing means over the top of the bag ends and over the turned tabs.

FIG. 15, is a sectional view, taken along line 15—15 of FIG. 5 showing in detail the cut off means of the applicants bag machine for cutting off the applied reinforcing tape at a predetermined location.

FIG. 16, is a side view, taken along line 16—16 of FIG. 15 showing in greater detail the cut off mechanism of the applicants bag sealing machine.

FIG. 17, is a sectional view, taken along line 17—17 of FIG. 5 showing in detail the pressure means of the applicants bag sealing machine for applying pressure to the reinforcing tape until the adhesive sets to provide a tightly sealed and reinforced bag.

FIG. 18 is a plan view, showing a modification of the perforator knife shown in FIG. 7.

FIG. 19 is a side view, taken along line 19—19 of FIG. 18.

FIG. 20 is a cross-sectional view, taken along line 20—20 of FIG. 18.

FIG. 21 is a partial perspective view of the modification of the perforator knife.

FIG. 22 is a side view, similar to the side view of FIG. 9 showing the modified turned tabs using the modified perforator knife of FIG. 18.

FIG. 23 is a side view of the applicant's new and novel bag having the reinforcing tape applied to both ends of the bag after the turned tabs are formed and positioned beneath the reinforcing tape.

DESCRIPTION OF THE PREFERRED EMBODIMENT

Figures 1, 2, 3, 4:
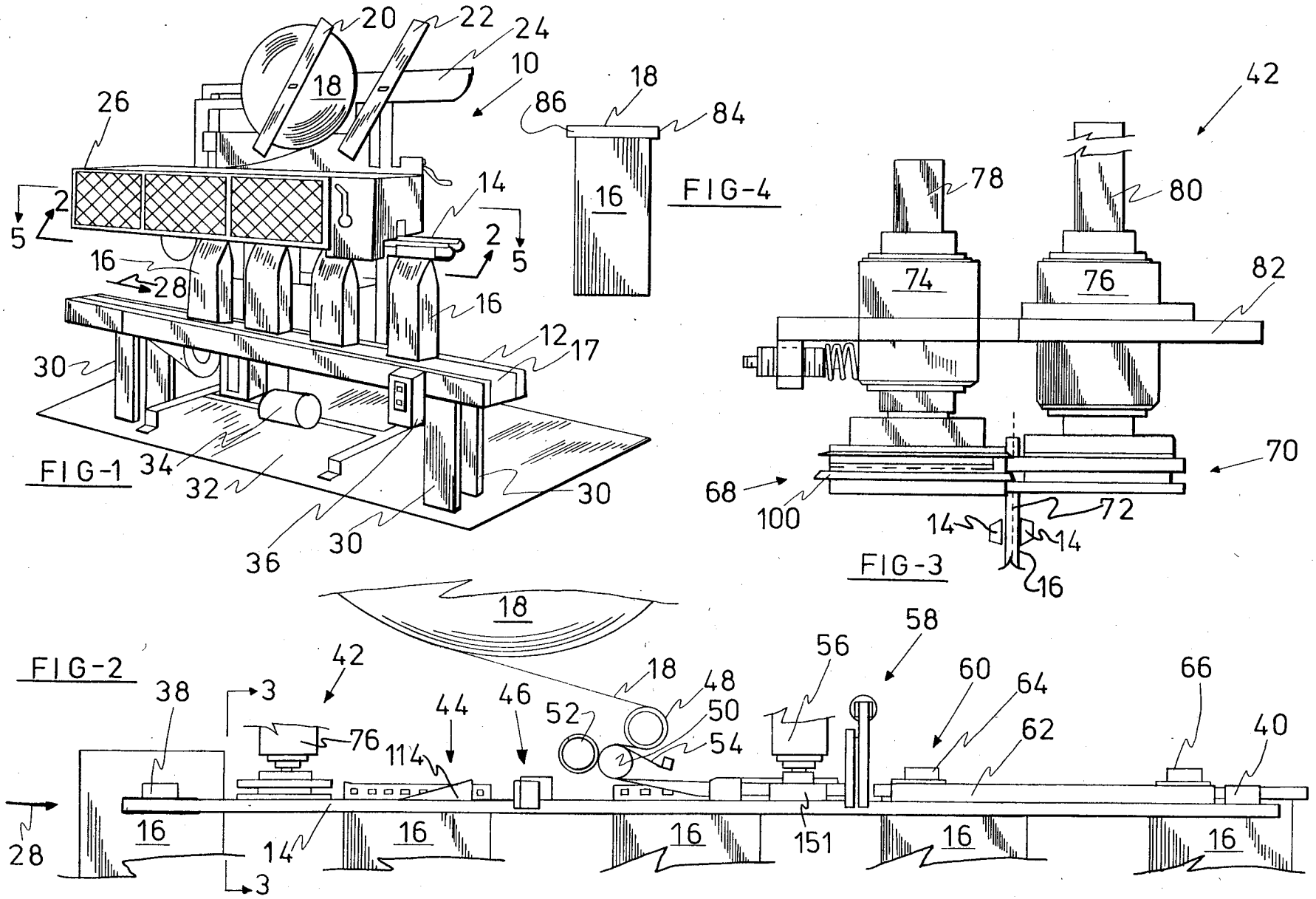
FIG. 1 is a perspective view of the applicants new and novel bag machine showing a plurality of bags passing through the machine and having their tops sealed as will be hereinafter described.
FIG. 2 is a side schematic type view, taken along line 2—2 of FIG. 1, showing in detail the individual components of the applicants novel bag sealing machine.
FIG. 3 is a cross sectional view, taken along line 3—3 of FIG. 2, showing in detail the perforator and bag trim assembly portion of the applicants bag machine.
FIG. 4 is a side view of the applicants new and novel bag having the reinforcing tape applied to one end of the bag.

Referring now to the drawings in general and in particular to FIG. 1 of the drawing there is shown the applicant's novel bag machine generally by the numeral 10 which comprises a frame 12 having conveyor means 14 attached to the frame for conveying a plurality of bags 16 on a conveyor belt 17 through the machine. Reinforcing means 18 in the form of a paper tape is positioned above the frame 12 and contains the roll of tape reinforcing means 18 held by a removable tape holder 20. A second removable tape holder 22 is used to position a second roll of reinforcing tape means 18. The reinforcing tape means 18 are carried by a frame 24 fixedly attached to the main machine frame 12 by means known in the art.

A guard 26 is positioned over the working elements of the applicant's novel bag machine for safety purposes and the bags 16 are conveyed through the machine in the direction shown by the arrow 28.

The machine proper is carried by a plurality of legs 30 which are positioned on the surface 32 of the floor of the bag line. A motor 34 and other motors may be utilized in the machine 10 for moving the various machine elements as desired and as known in the art of equipment design. An on-and-off switch 36 may be used by the operator to start and stop the machine 10 as desired.

Referring now to FIG. 2 of the drawing, there is shown a side schematic type view, taken along line 2—2 of FIG. 1 showing in detail the individual components of the novel bag sealing machine 10. As has been before mentioned a conveyor means 14 in the form of a plurality of conveyor belts is rotated on a plurality of pulleys 38 at the upstream end of the machine and a plurality of pulleys 40 on the downstream end of the machine. The conveyor belt means 14 would be rotated by known motor means within the spirit and scope of the invention. The conveyor means is carried and associated with the frame 12 and serves to move the filled bag 16 through the novel sealing machine. A perforator assembly, shown generally by the numeral 42 is carried by the frame 12 and serves to perforate a plurality of tab structures to be described more fully hereinafter along the open end of the filled bag.

A tab turner, shown generally by the numeral 44 is carried by the frame 12 and is positioned downstream from the perforator assembly 42 and is used for turning the tabs of the tab structure against one of the ends of the filled bag.

Adhesive means, shown generally by the numeral 46 are carried by the frame 12 and are used to apply adhesive to both sides of the open bag ends in a new and novel manner.

The reinforcing means 18, hereinbefore described are carried by the frame 24 with the reinforcing tape means 18 being looped around a plurality of rolls 48 and 50 and onto the top of the open end of the filled bag 16. A tape crease roll 52 is used to crease the tape 18 and a drag spring 54 serves to provide the necessary drag to the tape 18 to insure that the tape 18 is applied in an even manner to the top edge of the bag. A tape draw roll assembly 56 serves to draw the tape 18 in an even manner as is known in the art across the top of the bag 16.

Cutoff means shown generally by the numeral 58 are carried by the frame 12 and are positioned downstream from the reinforcing means 18 and serve to cut off the applied reinforcing means tape 18 at a predetermined location so that the bag has a neat appearing surface at the upper edge.

Pressure means, shown generally by the numeral 60 and comprising a pair of belts 62 positioned on each side of the moving bag are carried by the frame 12 and are positioned downstream from the cutoff means 58. The belts 62 are rotated around the pair of pulleys 64 and 66 and are driven by known means and serve to apply pressure to the applied reinforcing tape means 18 until the adhesive sets thereby providing a tightly sealed and reinforced bag having internally positioned tabs beneath the reinforcing tape 18. The adhesive means, shown generally by the numeral 46 which had been previousy applied to the upper ends of the bag serve in combination with the turned tabs and the reinforcing tape 18 to aid in reinforcing the bag end along the upper surface thereof.

Referring now to FIG. 3 of the drawing, there is shown a cross-sectional view, taken along line 3—3 of FIG. 2, showing in detail the perforator and bag trim assembly 42 which comprises a rotating male punch shown generally by the numeral 68 positioned adjacent to a rotating female die shown generally by the numeral 70. The bags 16 pass between the male punch assembly 68 and the female die assembly 70 longitudinally in the machine along the dashed line shown by the numeral 72. The male punch assembly 68 is carried by the structural member 74 while the female die assembly 70 is carried by the structural member 76, both of which are carried by the frame 82 fixedly attached to the main frame 12. The rotation of the male punch assembly 68 would be through the shaft 78 while the rotation of the female die assembly 70 would be through the shaft 80, with the shafts 78 and 80 being driven by various means such as gears, chains, motors and the like in a known timed manner. The purpose of the perforator assembly 42 would be to form a series of tab structures on the upper end of the bag 16 to aid in reinforcing the upper end of the bag as will be described more fully hereinafter. The tab structures would be positioned on the bag 16 which is shown in FIG. 4 of the drawing beneath the reinforcing tape 18 applied along the upper end of the bag as the bag 16 passes through the applicant's novel machine 10. The reinforcing tape 18 is cut off at its ends 84 and 86 by the cutoff means 58 as has been before described.

Figures 5, 6, 7, 7A, 8:
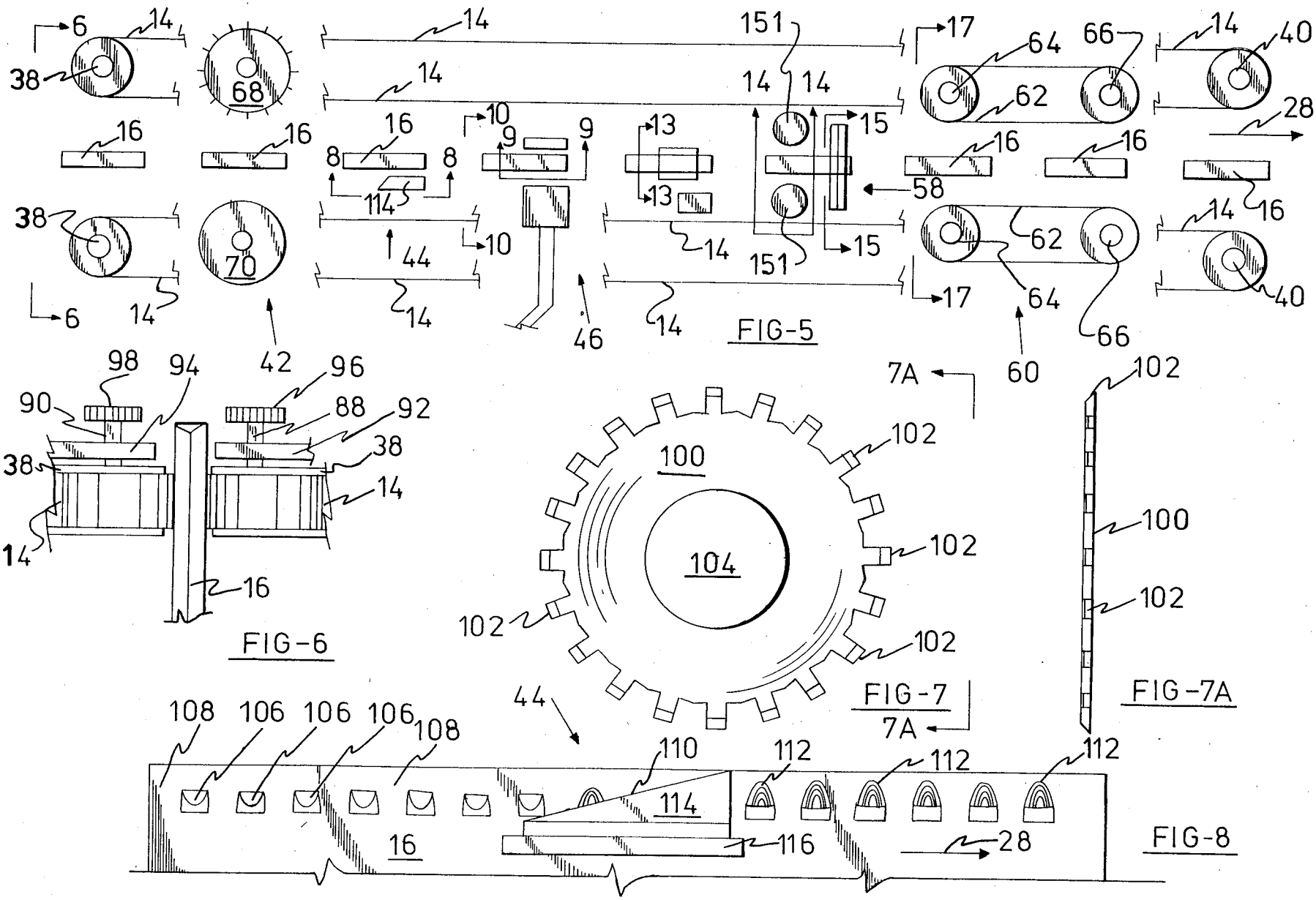
FIG. 5 is an elevational schematic view, taken along line 5—5 of FIG. 1 showing in greater detail the various components of the applicants novel bag sealing machine.
FIG. 6, is an end view, taken along line 6—6 of FIG. 5 showing the conveyor means for moving the filled bag through the sealing machine.
FIG. 7 is a plan view, showing the perforator knife of the perforator and bag trim assembly shown in FIG. 3.
FIG. 7A is a side view, taken along line 7A—7A of FIG. 7 showing in greater detail the construction of the perforator knife.
FIG. 8, is a side view, taken along line 8—8 of FIG. 5 showing in detail the tab turner for turning the tabs previously formed by the perforator assembly against one of the ends of the filled bag.

Referring now to FIG. 5 of the drawing there is shown an elevational schematic view, taken along line 5—5 of FIG. 1 showing in greater detail the various components of the applicant's novel bag sealing machine 10. For purposes of clarity, the main frame 12 and conveyor belt 17 have not been shown in FIG. 5 and other of the various components have also been eliminated and FIG. 5 is primarily an elevational schematic view to illustrate the basic components of the applicant's novel machine 10. As has been before described, the bags 16 pass through the machine in the direction shown by the arrow 28 being conveyed by the conveyor 14 in the form of a pair of conveyor belts positioned on each side of the bag. In FIG. 5, the conveyor belts 14 are shown positioned away from the bags 16 for purposes of clarity only and reference should be made to FIG. 6 of the drawing for the proper positioning of the conveyor belts 14 and their respective pulleys 38. The perforator assembly 42 is positioned as shown in FIG. 3 and contains the male punch assembly 68 positioned on one side of the line with the female die assembly 70 positioned on the opposite side of the line. The remaining portions of the bag machine are shown in FIG. 5 and by reference to FIG. 5 in conjunction with FIG. 2 there can be seen the novel components of the applicant's bag machine 10.

Referring now to FIG. 6 of the drawing there is shown an end view, taken along line 6—6 of FIG. 5 showing the conveyor means 14 for moving the filled bag through the sealing machine. As has been before mentioned, the conveyor means 14 would comprise a pair of pulleys 38 positioned where shown adjacent to the bag 16 and would be carried by the shafts 88 and 90 which are in turn carried by the frames 92 and 94 fixedly attached to the main frame 12 in a manner known in the art. A pair of gears 96 and 98 are carried by the shafts 88 and 90 and are connected to drive chains not shown in the drawing for the purpose of rotating the pulleys 38 to drive the conveyor belt 14, and in turn the bags 16 through the applicant's machine. On the downstream end of the bag machine 10, the pulleys 40 would be positioned in a similar manner to that shown in FIG. 6 and would be connected to the conveyor belt means 14 to complete the conveying of the bags 16 through the machine 10.

Referring now to FIG. 7 of the drawing there is shown in greater detail the male punch used in the perforator assembly 42 which comprises a circular plate 100 having formed thereon a plurality of punches 102 with the plate 100 having formed in the center thereof a hole 104 for mounting the plate in the perforator assembly. The punches 102 are sharpened and serve to form the tab structure to be described more fully hereinafter when the plate 100 is positioned in the perforator assembly 42 and in particular in the male punch assembly 68 as shown in FIG. 3 of the drawing. In FIG. 3 it should be noted that the plurality of sharpened punch structures 102 have not been shown for purposes of clarity in the drawing and it can be seen how the plate 100, when positioned in the assembly 68 and used in juxtaposition to the female die assembly 70, would form a series of punched tab structures in the upper end of the bag.

FIG. 7A is a side view, taken along line 7A—7A of FIG. 7 showing in greater detail the construction of the perforator plate 100 which serves as a perforator knife when the plurality of punches 102 are formed on the plate as shown in FIG. 7.

Referring now to FIG. 8 of the drawing, there is shown a side view, taken along line 8—8 of FIG. 5 showing in detail the tab structures formed by the perforator assembly 42 and also showing in detail the tab turner 44 for turning the tabs previously formed by the perforator assembly against one of the ends of the filled bag. It can be seen in FIG. 8 how the previously described perforator assembly 42 forms a series of tabs 106 along the upper end 108 of the bags 16 which pass through the applicant's novel machine. The purpose of the tab turner 44 is to turn or wipe the tabs 106 in an upwardly direction as the tabs 106 pass along the inclined surface 110 as that particular bag passes through the bag machine in the direction shown by the arrow 28. FIG. 8 shows a bag 16 positioned with a plurality of tabs 106 punched out of the upper end 108 of the bag with the tab turner 44 showing the tabs 106 then being turned upwardly to the position shown at the numerals 112 on the right side of FIG. 8. The inclined surface 110 of the tab turner 44 would be formed on the plate 114 which would be carried by a frame 116 fixedly attached in turn to the main frame 12 but not shown in the drawings. Since the tabs 106 are punched outwardly to form the tab structure and are positioned only on one side of the bag 16, then only one tab turner 44 is necessary, positioned on the side of the machine shown in FIG. 5 of the drawings.

Figure 9:
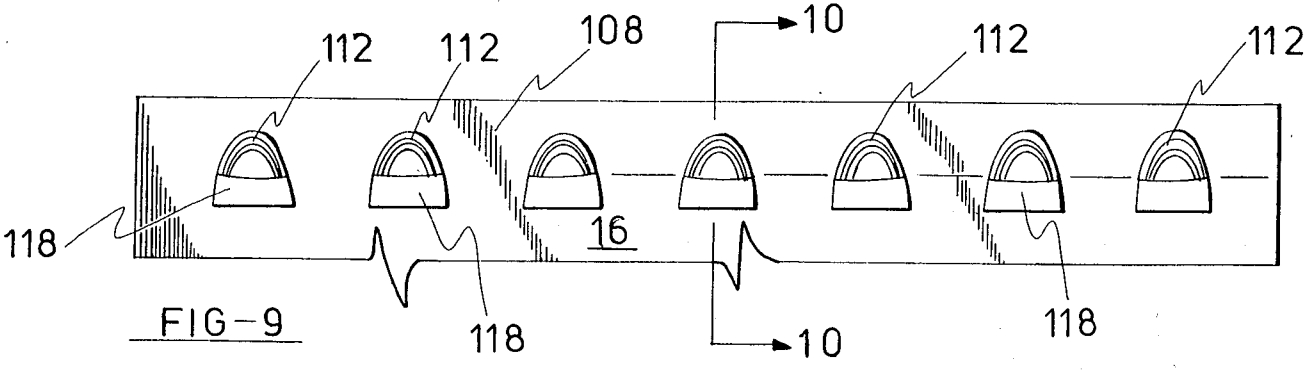
FIG. 9, is a side view, taken along line 9—9 of FIG. 5 showing the turned tabs positioned upwardly against one of the ends of the filled bag prior to adhesive being applied to the bag edge and to the tabs and through the openings formed by the tabs.

Referring now to FIG. 9 of the drawing, there is shown a side view, taken along line 9—9 of FIG. 5 showing the turned tabs 112 positioned upwardly against one of the ends 108 of the filled bag 16 prior to adhesive being applied to the bag edge and to the tabs 112 and through the openings 118 formed by the turned tabs. In FIG. 9, the bag 16 has been represented as a multi-wall bag which would result in a plurality of adjacent tabs 112 formed out of the multiple ply of bag.

Figure 10:
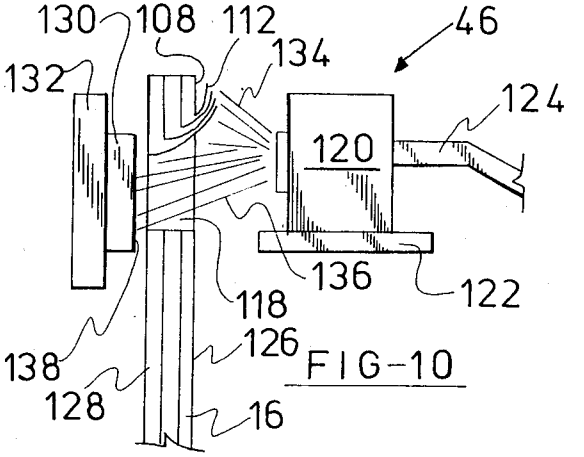
FIG. 10 is a sectional view, taken along line 10—10 of FIGS. 5 and 9 showing the adhesive means for applying adhesive to both sides of the tab with the adhesive nozzle spraying adhesive on one side of the bag and through the opening formed in the bag by the turned tab structure to the vertical wiper plate on the other side of the bag.

Referring now to FIG. 10 of the drawing, there is shown a sectional view, taken along line 10—10 of FIGS. 5 and 9 showing the adhesive means generally by the numeral 46 which would comprise an adhesive nozzle 120 positioned on a frame 122 which would in turn be carried by the main frame 12 not shown in the drawing. An adhesive line 124 would be connected to a supply of adhesive for application of the adhesive by the nozzle 120. In the preferred embodiment, there would be used only one adhesive nozzle 120 or adhesive means which would be positioned adjacent to one side 126 of the bag. Positioned on the other side 128 of the bag 16 would be a stationary vertical wiper plate 130 carried by a frame 132 in turn connected and fixedly attached to the main frame 12 but not shown in the drawing. When the preferred embodiment using one adhesive means in the form of one adhesive nozzle 120 shown in FIG. 10, then the nozzle 120 would spray the upturned tabs 112 by a portion of the spray 134 to apply adhesive to the upturned tab. In addition a lower portion of the spray 136 would pass through the openings 118 formed by the tab structure and would strike the wiper plate 130 on the surface 138. For purposes of clarity, the wiper plate 130 and its wiper surface 138 have been shown positioned somewhat away from the bag 16 and its other face 128. However in order to function properly, the wiper plate 130 and its wiper surface 138 would be positioned relatively close to the surface 128 of the bag. In this manner, the adhesive spray 136 passing through the openings 118 would strike the wiper surface 138 and would in turn wipe a predetermined amount of adhesive on the other side 128 of the bag.

Figure 11:
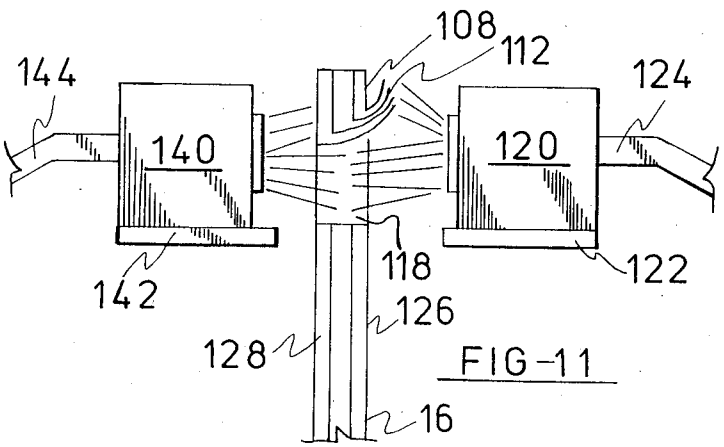
FIG. 11 is a sectional view similar to the sectional view of FIG. 10, taken along line 10—10 of FIGS. 5 and 9 showing a modification of the adhesive means where an adhesive nozzle is positioned on each side of the bag.

Referring now to FIG. 11 of the drawing, there is shown a sectional view similar to the sectional view of FIG. 10, taken along line 10—10 of FIG. 9 showing a modification of the adhesive means where an adhesive nozzle 140 has been positioned on the opposite side of the bag to the adhesive nozzle 120. The adhesive nozzle 140 would be carried by a frame 142 which would in turn be carried by the main frame 12 but not shown in the drawing. A second adhesive line 144 would supply adhesive from an external source to the adhesive nozzle 140. When positioned thusly, the two adhesive nozzles 120 and 140 would then serve to direct adhesive spray to both sides 126 and 128 of the bag 16 along the upper end 108. It may also be desirable when using two adjacent nozzles 120 and 142 to position the nozzles somewhat apart from each other so that they do not spray adhesive through the openings 118 to interfere with each other. In addition it may also be desirable to readjust the spray nozzles on each particular spray so that only the turned tab portion 112 is sprayed with adhesive and the opposite side 128 adjacent to the turned tab 112 would have adhesive applied also.

Figure 12:
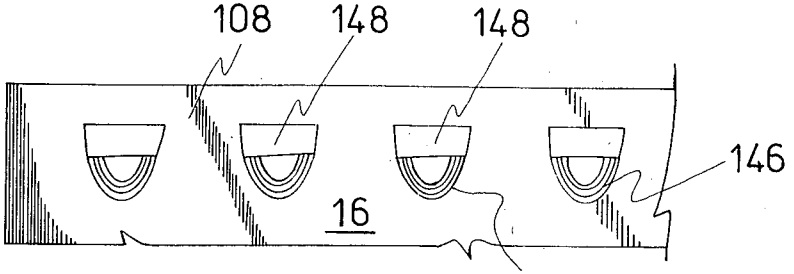
FIG. 12, is a side view, similar to the view shown in FIGS. 5 and 9 showing a modification of the turned tab structure wherein the tabs are turned downwardly instead of upwardly as is shown in FIG. 9 of the drawings.

Referring now to FIG. 12 of the drawing, there is shown a side view, similar to the view shown in FIG. 9 showing a modification of the turned tab structure wherein a plurality of tabs 146 would be turned downwardly leaving the series of holes 148 positioned above the downturned tab on the bag 16. When formed in this modification it should become apparent that the tab turner 44 would have to be inverted and repositioned so that its inclined surface would turn the tabs downwardly as shown in FIG. 12 and not upwardly as shown in FIG. 8. In FIG. 12, the bag 16 is also shown as a multi-wall bag which would have a series of plies forming the turned tab 146. In other words when the bag 16 was formed as a multi-wall bag, the turned tab 146 would consist of a series of tabs lying adjacent to each other which would all be formed by the use of the perforator assembly 42 and in particular the cutting of the punches 102 against the female die assembly 70 as shown in FIG. 3 of the drawing. When the modification of FIG. 12 would be utilized with downturned tabs 146 then it should also be apparent that the perforator assembly 42 would also be modified by inverting the plate 100 in the male punch assembly 68 so that the tabs would be formed downwardly positioned as shown in FIG. 12. The tab structures can also be formed in other manners and conceivably could be formed alternately with an upwardly turned tab and a downwardly turned tap which would necessitate two perforator assemblies 42 positioned adjacent to each other in the assembly line and modified to form an alternating upwardly turned and downwardly turned tab. Other modifications may be made in the tab structure and in particular the configuration of the tab and the positioning of the tab when turned on one of the bag, within the spirit and scope of the invention.

Referring now to FIG. 13 of the drawings there is shown a sectional view, taken along line 13—13 of FIG. 5 showing in greater detail the positioning of the reinforcing tape means 18 to the side of the open bag ends over the tab structures before described and the openings formed by the tabs. As has been before mentioned, the tape 18 has been creased by the tape creasing roll 52 and would be overlapped over both sides of the upper end of the bag 16 as shown in FIG. 18. A forming flange member 150 in a general U-shaped configuration would be carried by a frame 152 which in turn would be fixedly attached to and carried by the main frame 12 but not shown in the drawings. As has been before described, the adhesive has been positioned on each side of the bag upper ends 108 either by the FIG. 10 preferred embodiment or the FIG. 11 modification and the application of the reinforcing paper tape means 18 would then serve to tightly position the upturned tabs 112 beneath the reinforcing tape.

FIG. 14 shows a side view, taken along line 14—14 of FIG. 5 showing in greater detail the positioning of the reinforcing tape 18 as it is applied to the upper edges of the bag 16 as the tape passes through the forming flange member 150 being pulled by the tape draw roll assembly 56 as the pair of rollers 151 tightly grasp and pull the tape 18 from the tape holder 20. The tape draw roll assembly 56 would drive the rollers 151 which have been positioned on each side of the bag 16 through the shaft 156. It can be seen in FIG. 14 how the reinforcing tape 18 would then be tightly folded and positioned over the upper end 108 of the bag 16 in a continuous manner as shown on the right side of FIG. 14.

Referring now to FIG. 15 and 16 of the drawing there is shown in FIG. 15 a sectional view, taken along line 15—15 of FIG. 5 showing in detail the cutoff means 58 for cutting off the applied reinforcing tape 18 at a predetermined location. The cutoff means 58 would be positioned in the bag machine line at the location shown in FIGS. 2 and 5 and would be carried by a frame 158 fixedly attached to the main frame 12 but not shown in the drawing. The frame 158 would have fixedly attached thereto an elongated member 160 which would carry a vertically positioned elongated member 162 by means of a nut 164, tightly screwed onto the shaft 166 which has been positioned into a tapped hole 168 formed in the elongated member 162. An inverted U-shaped opening 170 is formed in the elongated member 162 as well as in the adjacent elongated member 172 which is also fixedly attached to the shaft 166 by the nut 164. A downwardly positioned cutter knife 174 is then positioned between the spaced apart elongated members 162 and 172 and serves as a means to cut the reinforcing tape 18 as the upper end 108 of the bag 16 passes through the U-shaped opening 170. The cutter knife 174 is pivoted on a pin 176 and a hydraulic or air cylinder 178 is used to drive the cutter knife 174 by means of the cylinder shaft 180. The cutter knife 174 is also pivoted on the shaft 166 and it can be seen in FIG. 15 how the cutter knife 174 will rotate about the shaft 166 as the cylinder 178 drives the shaft 180 and forces the member 182 against the pin 176. When constructed thusly, the cylinder 178 can be timed by known timing means to sever the tape 18 at a predetermined location to make the bag 16 ultimately appear as shown in FIG. 4 of the drawing with the tape 18 evenly cut on each side 84 and 86 of the bag.

Referring now to FIG. 17 of the drawing there is shown a sectional view, taken along line 17—17 of FIG. 5 showing in detail the pressure means 60 of the applicant's machine which comprises a pair of pulleys 64 positioned on each side of the bag 16. The pulleys 64 drive the belt 62 by known means and are connected to the shaft 184 and are carried by the frames 186 which are in turn carried by the main frame 12 but not shown in the drawing. A pair of gears 188 are driven by chains and motors not shown in the drawing to time the pulleys 64 to be in synchronization with the timing of the conveyor belt means 14. The pulleys 64 would be positioned to direct an inward force shown by the arrows 190 against the folded tape 18 to apply pressure to the tape 18 until the adhesive sets thereby providing a tightly sealed and reinforced bag 16 having internally positioned tabs glued beneath the reinforcing tape to serve in aiding the reinforcing of the bag along the upper ends.

In the applicant's novel method, the adhesive would be sprayed through the openings formed in the tab structure and would hit the stationary vertical wiper plate 130 which would preferably be formed of aluminum. The plate would be kept hot be being attached to the glue head or some other means to insure that the glue would remain tacky on the target.

All intermittent actions such as gluing, tape feeding and tape cutoff are controlled by either electric eye or limit switches and are activated by the edges of the bag 16 passing through the machine thereby requiring no adjustments for different width bags.

The stations in the applicant's novel bag machine would be mounted on a stationary inner plate or a movable outer plate allowing the sealer to be separated at the bag line for easy maintenance and clearing of jams.

Referring now to FIG. 22 of the drawing there is shown a modified turned tab 192 formed near the edge 194 of a bag 16. The modified turned tab 192 is formed by the modified male punch 196 shown in FIGS. 18–21 of the drawing. When formed as shown in FIG. 22, the modified turned tab 192 would be turned at an angle shown by the numeral 198.

The male punch 196 as shown in FIG. 18 of the drawing would be formed with a plurality of teeth 200 which would be spaced apart approximately 18° as shown by the numeral 202. The modified male punch 196 is made to cut the top and bottom of the bag as it enters the female die 70 of the type shown in FIG. 3 of the drawing. The top of the punch is relieved to keep it from cutting all the way across the top of the opening 204 in the bag. This relief lets the tab turn up at the angle shown by the numeral 198 to provide a more desirable tab. In order to obtain this configuration, the teeth 200 would be formed approximately 7/32" in width as shown by the arrow 206 and would be formed approximately ⅜" deep as shown by the arrow 208.

To obtain the relief necessary, an angle of approximately 45° as shown by the arrow 210 in FIG. 19 would be used and a further angle of approximately 10° as shown by arrow 212 in the perspective of FIG. 21. The male perforator punch 196 would be formed approximately 2/10" thick as shown by the arrow dimension 214 with the diameter of the punch being approximately $4\frac{3}{8}''$ as shown by the arrow 216. When formed in this manner with a bore of approximately $1\frac{7}{8}''$, as shown by the dimension 218, the modified male punch 196 will form the modified turned tab 192 as shown in FIG. 22.

The applicant's basic invention may also be formed on one or both ends of a bag tube 220 as manufactured from a tubing machine. When formed thusly, both ends of the bag tube 220 would have applied thereto the reinforcing tape 18 under which would be formed the series of turned tabs of the types hereinbefore described having adhesive applied thereto beneath the reinforcing tape. In this manner an extra strong bag is obtained with both sealed top and bottom ends using the applicant's novel sealing method.

Other modifications may be employed in the applicant's device within the spirit and scope of the invention. For example the pressure means 60 as hereinbefore described may take the form of a pair of pressure belts 62 as has been described. In addition the pressure means 60 may be formed using solid metal compression rolls instead of the flat pressure belts 62. The solid metal compression rolls can be slave driven off of the bag carriage belts used to transport the bags through the machine.

Othe modifications are within the spirit and scope of the invention in the use of glue nozzles that may apply sprays or a single bead of hot melt in the vicinity of the turned tab holes to accomplish the same purpose.

From the foregoing it can be seen that the applicant's new and novel bag machine and novel bag provide a much stronger reinforced top and/or bottom of a filled bag than has been heretofore possible with other bag closing machines. By the improved sealing of the top and/or bottom of the bag using the novel turned tabbed structures, either turned upwardly or downwardly or in some variation thereof, the application of the reinforcing tape to the upper ends of the bag over the turned tabs and the adhesive, makes a much stronger reinforced top and/or bottom. Using the preferred embodiment of one spray nozzle spraying adhesive through the openings formed by the tab structure, eliminates the added expense of providing for two spray nozzles and serves as a novel way to apply adhesive to both sides of adjacent surfaces.

It should be apparent after studying the drawings and reading the description of the preferred embodiment and its modifications that other changes may be made in the arrangement of the parts and the positioning of the various structures and devices in the machine and also in the formation of the tab structures within the spirit and scope of the invention. The applicant is not to be limited to the exact embodiment shown which has been given by way of illustration only.

Having described our invention, we claim:

1. A bag sealing machine for sealing the open end of a filled bag, comprising:
   (a) a frame;
   (b) conveyor means, associated with the frame, for moving the filled bag through the sealing machine;
   (c) a perforator assembly, carried by the frame, for perforating a plurality of tab structures along the open end of the filled bag, the tab structures being cut through the filled bag;
   (d) a tab turner, carried by the frame and downstream from the perforator assembly, for turning the tabs against one of the ends of the filled bag, whereby the plurality of turned tabs serve to reinforce the bag end;
   (e) adhesive means, carried by the frame, for applying adhesive to both sides of the open bag ends;
   (f) reinforcing means, carried by the frame and downstream from the adhesive means, for applying reinforcing to the side of the open bag ends over the tabs and openings formed by the tabs;
   (g) cut-off means, carried by the frame and downstream from the reinforcing means, for cutting off the applied reinforcing means at a predetermined location; and
   (h) pressure means, carried by the frame and downstream from the cut-off means, to apply pressure to the applied reinforcing means until the adhesive sets thereby providing a tightly sealed and reinforced bag having internally positioned tabs beneath the reinforcing means which serve to aid in reinforcing the bag end along with the reinforcing means.

2. The bag sealing machine as defined in claim 1 wherein the perforator assembly comprises a rotating male punch positioned on one side of the bag, and a rotating female die positioned on the other side of the bag, the rotating punch and die serving to form the tab structure.

3. The bag sealing machine as defined in claim 1 wherein the tab turner comprises a stationary member having an inclined wiping edge for turning the tab as the bag and tab structure are moved through the tab turner.

4. The bag sealing machine as defined in claim 1 wherein the adhesive means comprises at least one spray nozzle positioned on one side of the bag end; the adhesive being applied on one side of the bag end ajacent to the plurality of turned tabs.

5. The bag sealing machine as defined in claim 1 wherein the adhesive means comprises a spray nozzle positioned on each side of the bag end; the adhesive being applied to both sides of the bag end adjacent to the plurality of turned tabs.

6. The bag sealing machine as defined in claim 1 wherein the adhesive means comprises a spray nozzle positioned on one side of the bag end and further comprises a stationary vertical wiper plate positioned adjacent the spray nozzle on the other side of the bag end, the spray nozzle spraying adhesive onto one side of the bag end and through the tab structure to the other side of the bag end onto the stationary vertical wiper plate which wipes the other side of the bag end with adhesive.

7. The bag sealing machine as defined in claim 1 wherein the reinforcing means is tape.

8. The bag sealing machine as defined in claim 1 wherein the adhesive means comprises the application of a single bead of adhesive on one side of the bag end adjacent to each of the plurality of turned tabs.

9. The bag sealing machine as defined in claim 1 wherein the adhesive means comprises the application of a single bead of adhesive to both sides of the bag end adjacent to each of the plurality of turned tabs.

10. A bag sealing machine for sealing the open end of a filled bag, comprising:
   (a) a frame;
   (b) conveyor means, associated with the frame, for moving the filled bag through the sealing machine;

(c) a perforator assembly, carried by the frame, for perforating a plurality of tab structures along the open end of the filled bag;

(d) a tab turner, carried by the frame and downstream from the perforator assembly, for turning the tabs against one of the ends of the filled bag;

(e) adhesive means, carried by the frame, for applying adhesive to both sides of the open bag ends; the adhesive means comprising a spray nozzle positioned on one side of the bag end and further comprising a stationary vertical wiper plate positioned adjacent the spray nozzle on the other side of the bag end, the spray nozzle spraying adhesive onto one side of the bag end and through the tab structure to the other side of the bag end onto the stationary vertical wiper plate which wipes the other side of the bag end with adhesive;

(f) reinforcing means, carried by the frame and downstream from the adhesive means, for applying reinforcing to the side of the open bag ends over the tabs and openings formed by the tabs;

(g) cut-off means, carried by the frame and downstream from the reinforcing means, for cutting off the applied reinforcing means at a predetermined location; and (h) pressure means, carried by the frame and downstream from the cut-off means, to apply pressure to the applied reinforcing means until the adhesive sets thereby providing a tightly sealed and reinforced bag having internally positioned tabs beneath the reinforcing means which serve to aid in reinforcing the bag end along with the reinforcing means.

* * * * *